United States Patent [19]

Deeg

[11] 4,378,478

[45] Mar. 29, 1983

[54] DOUBLE-DOMED ELASTOMERIC KEYBOARD ELEMENT

[75] Inventor: Reinhard Deeg, Keltern, Fed. Rep. of Germany

[73] Assignee: International Standard Electric Corporation, New York, N.Y.

[21] Appl. No.: 296,628

[22] Filed: Aug. 27, 1981

[30] Foreign Application Priority Data

Aug. 29, 1980 [DE] Fed. Rep. of Germany ..... 3032557

[51] Int. Cl.[3] ..... H01H 13/70

[52] U.S. Cl. ..... 200/159 B; 200/340

[58] Field of Search ..... 200/159 B, 340, 239, 200/306, 264

[56] References Cited

U.S. PATENT DOCUMENTS 3,766,350 10/1973 Van Dyk et al. ..... 200/159 R X
3,879,586 4/1975 DuRocher et al. ..... 200/264 X
3,898,421 8/1975 Suzumura ..... 200/159 B
3,932,722 1/1976 Obata et al. ..... 200/340
3,950,627 4/1976 Murata et al. ..... 200/264 X
4,127,758 11/1978 Lowthorp ..... 200/340

FOREIGN PATENT DOCUMENTS 1124333 8/1968 United Kingdom ..... 200/159 B

*Primary Examiner*—John W. Shepperd
*Assistant Examiner*—Renee Kidorf
*Attorney, Agent, or Firm*—James B. Raden; William J. Michals

[57] ABSTRACT

A double-domed elastomeric keyboard element is disclosed in which a solid contact disc is connected to the junction of the domes of the keyboard element housing. The inner dome is provided on its inside with a downwardly extending projection which engages the contact disc when the keyboard element is depressed to press the disc against a pair of conductors on a printed circuit board below the element. Because of the non-positive connection between the key plunger and the conductors, the contact pressure is almost equal to the operating force.

4 Claims, 3 Drawing Figures

DOUBLE-DOMED ELASTOMERIC KEYBOARD ELEMENT

BACKGROUND OF THE INVENTION

The present invention relates generally to a keyboard element and, more particularly, to a double-domed elastomeric keyboard element.

U.S. Pat. No. 4,127,758 discloses a domed elastomeric keyboard element. There is also known a double-domed elastomeric keyboard element in which a conductive, elastomeric moving contact member is located inside the keyboard element housing and joined thereto at the junction of the two domes. When the keyboard element is actuated, the moving contact member shifts downwardly to bridge a pair of conductors on a printed circuit board serving as a support for the keyboard element.

In the aforementioned prior art double-domed keyboard element, the moving contact member is formed as a ring. When pressure is applied to the upper dome of the element, the larger lower dome is initially deformed. After a certain partial travel of the keyboard element the lower dome collapses whereupon the contact ring engages the conductors on the printed circuit board below the element. The force of application is determined by the tension of the material of the upper dome. This force cannot be greater than the maximum actuating force permitted for the respective type of pushbutton keys. In the case of alpha-numeric keyboards, this force ranges from 50–100 g. In order to assure a reliable contact being made with the conductors on the printed circuit board there is required an expensive surface treatment of the contact member of the keyboard element.

The upper dome permits a certain over travel which is necessary for extending the contact closing period. However, collapsing of the upper dome must be avoided. This can be achieved by restricting the travel of the actuating plunger operating the keyboard element. The contact pressure, in fact, reduces itself by the sum of the return forces of the collapsed domes acting in opposition to the applied force. Moreover, the additional flexing considerably reduces the cycle life of the keyboard element.

It is the object of the present invention to improve and optimize the function of a double-domed keyboard element.

SUMMARY OF THE INVENTION

According to the present invention, a double-domed keyboard element of the general type described hereinabove is modified by providing a projection on the upper dome over the moving contact member and by forming an upperwardly facing supporting surface on the moving contact member which is engageable by the projection.

By this arrangement, actuation of the keyboard element results in a non-positive connection between the key plunger and the conductors on the printed circuit board below the element, enabling a considerably higher contact pressure than heretobefore obtained. In this way, the average final application force of 300 g. as occurs when operating alpha-numeric keyboards can be achieved as the contact pressure. In this manner, expensive surface treatment of the moving contact can be avoided. Moreover, because of the nonpositive connection, it is no longer necessary to take special steps within the pushbutton element for limiting the travel of the key plunger.

DESCRIPTION OF THE PREFERRED EMBODIMENT

Figure 1:
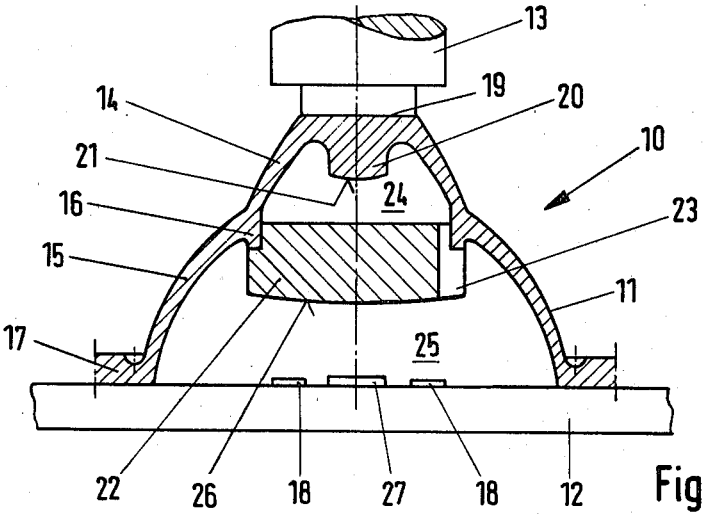
FIG. 1 is a partial vertical sectional view of a double-domed keyboard element according to the present invention.

Referring now to the drawing in detail, the keyboard element of the present invention, generally designated 10, comprises a double-domed body or housing 11 mounted over a printed circuit board 12, and a key plunger 13. The housing 11 is formed of an elastomeric material, such as silicone rubber, and is formed by an upper dome 14 and a lower dome 15 of a diameter larger than that of the upper dome. The domes merge at a junction 16. The lower dome 15 has at its lower end an outwardly extending annular flange portion 17 which rests on the printed circuit board 12. The board includes a pair of conductors or traces over which the housing 11 is centrally located. The upper dome 14 embodies an upperwardly facing flat surface 19 which is engaged by plunger 13.

The upper dome 14 is provided on its inside with a downwardly extending projection 20 which is concentric with respect to the center vertical axis of the double-domed housing 11. The underside 21 of the projection is crowned as shown. At the junction 16 of the upper and lower domes there is provided on the inside an annular lip on which there is mounted a solid small contact disc 22 of electrically conductive silicone rubber or the like which is firmly connected to the housing of the keyboard element by vulcanizing or any other suitable means. The contact disc is provided on its outer surface with at least one air escape vertically extending channel 23 through which the interior spaces 24 and 25 of the upper and lower domes, respectively, are in communication with each other. The underside 26 of the contact disc 10 also has a crowned face. For air compensation purposes, the rim portion 17 of the housing has an air passage slot 27 which opens to the outside of the housing.

Figure 2:
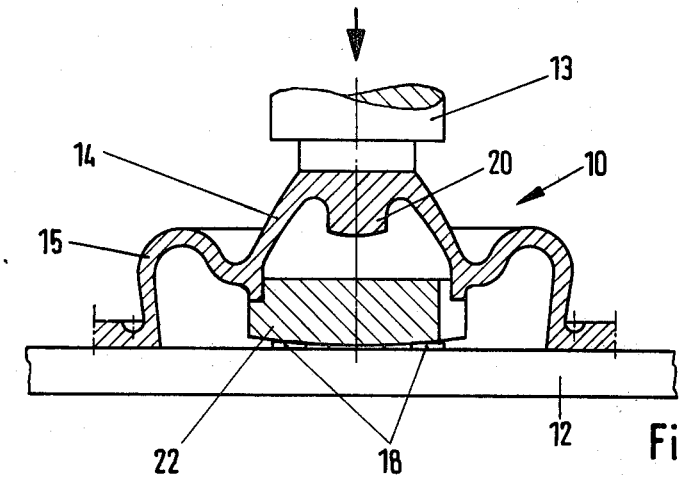
FIG. 2 shows the keyboard element of FIG. 1 in a state of being almost half depressed.

When a downward force is applied to the keyboard element 10 in the direction indicated by the arrow in FIG. 2, by the action of the key plunger 13, the lower dome 15 is caused to collapse in the manner shown after a certain travel of the key plunger. The negative force appearing in the course of this travel imparts a tactile feedback signal to the user upon depression of the key. The contact disc 22 bridges the conductors on the printed circuit board thereby electrically interconnecting them. The contact pressure prevailing in the course of the depression of the keyboard element is restricted by the elasticity resulting from the tension (tensile stress) of the material of the upper dome 14, less the return force of the collapsed lower dome 15. After contact is made between the disc 22 and the conductors on the printed circuit board, an over travel is required which is achieved by a subsequent deforming of the upper dome 14.

Figure 3:
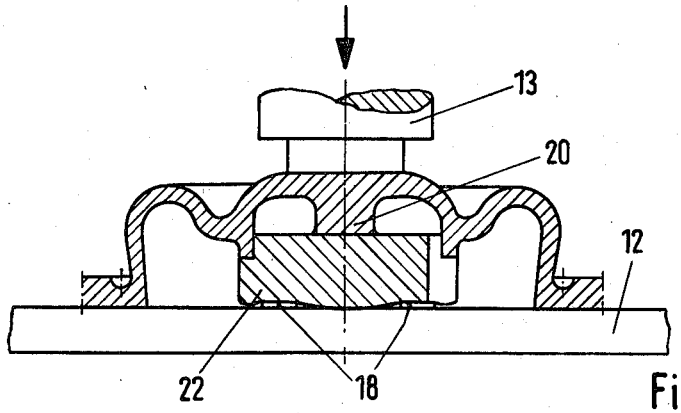
FIG. 3 shows the keyboard element of FIG. 1 in a state of being completely depressed.

FIG. 3 shows the end phase of the actuated keyboard element, in which there is established a non-positive connection between the key plunger 13 and the conductor 18 of the printed circuit board via the projection 20 and the small contact disc 22. By this arrangement almost the entire force with which the key plunger is actuated acts upon contact making parts. Because of the crowned undersides of the projection 20 and the contact disc 22 there is achieved an elastic (flexible) transition to the limit stop position. Owing to this feature, it is no longer necessary to take any special measures for restricting the travel of the key plunger as in the prior art arrangement discussed hereinabove.

When the key plunger is released, the keyboard element, because of the aforementioned return forces in the deformed domes 14 and 15, automatically returns to its normal position as shown in FIG. 1. Accordingly, no special means is required for resetting the key plunger.

When several such keyboard elements 10 are assembled to form a mat-like unit, the individual keyboard elements are preferably in engagement with each other through the flange portions 17.

What is claimed is:

1. In a keyboard element having a hollow double-domed elastomeric housing including an upper dome and a lower dome of greater diameter than said upper dome, said domes intersecting at an annular junction, and a conductive elastomeric moving contact member mounted inside said housing connected to said junction, said moving contact member being adapted to bridge conductors on a substrate below said housing, the improvement which comprises:

a projection extending downwardly from an upper region of said upper dome over said moving contact member;

and said moving contact member embodying an upwardly facing supporting surface engageable by said projection.

2. A keyboard element as set forth in claim 1 wherein:

said housing has a central vertical axis with respect to which said domes are concentric; and said projection is concentric with respect to said axis.

3. A keyboard element as set forth in claim 1 wherein:

said moving contact member is a solid contact disc formed with an air-escape channel communicating the interiors of said domes.

4. A keyboard element as set forth in claim 1 wherein:

the undersides of both said projection and said contact disc have crowned faces.

* * * * *